US006681555B1

(12) United States Patent
Heisel et al.

(10) Patent No.: US 6,681,555 B1
(45) Date of Patent: Jan. 27, 2004

(54) FALSE TWISTER, ESPECIALLY FOR PRODUCING SPIRAL FILAMENTS

(75) Inventors: Bernd Heisel, Metterlach (DE); Siegfried Doujak, Merzig (DE)

(73) Assignee: Drahtcord Saar GmbH & Co. KG, Merzig (DE)

( * ) Notice: Subject to any disclaimer, the term of this patent is extended or adjusted under 35 U.S.C. 154(b) by 0 days.

(21) Appl. No.: 09/914,644

(22) PCT Filed: Mar. 17, 2000

(86) PCT No.: PCT/EP00/02420

§ 371 (c)(1),
(2), (4) Date: Nov. 21, 2001

(87) PCT Pub. No.: WO00/56961

PCT Pub. Date: Sep. 28, 2000

(30) Foreign Application Priority Data

Mar. 18, 1999 (DE) ..... 199 12 192

(51) Int. Cl.[7] ..... D02G 1/04
(52) U.S. Cl. ..... 57/284; 57/311
(58) Field of Search ..... 57/2.3, 2.5, 284, 57/285, 289, 309, 311, 333, 334, 335, 344, 346, 348, 902, 1 UN

(56) References Cited

U.S. PATENT DOCUMENTS 3,782,090 A * 1/1974 Edwin et al. ..... 57/288
4,154,051 A * 5/1979 Takagi ..... 57/284
4,208,864 A * 6/1980 Kaes ..... 57/58.34
4,385,486 A * 5/1983 Iwata et al. ..... 57/58.52
6,151,879 A * 11/2000 Doujak ..... 57/311

FOREIGN PATENT DOCUMENTS

| | | | |
|---|---|---|---|
| DE | 19535595 | 3/1997 | |
| EP | 627521 | 12/1994 | |
| GB | 1554927 | 10/1979 | |
| GB | 1554927 A * | 10/1979 | ..... B21F/7/00 |

* cited by examiner

*Primary Examiner*—Gary L. Welch
*Assistant Examiner*—Shaun R Hurley
(74) *Attorney, Agent, or Firm*—Stevens, Davis, Miller & Mosher, LLP

(57) ABSTRACT

The invention relates to a false twister (10), especially for producing spiral filaments. The false twister comprises a rotatably driven twister (17) with at least one guide roller (18) around which the filaments (11) are wrapped. The aim of the invention is to reduce the forces that act upon the spiral filaments (11'). To this end, at least one guide roller (18) is driven. According to a method for producing spiral filaments (11) the power necessary for moving the filaments (11) through the false twister (10) is at least partially applied on the filaments (11) in the false twister (10).

22 Claims, 3 Drawing Sheets

FALSE TWISTER, ESPECIALLY FOR PRODUCING SPIRAL FILAMENTS

FIELD THE INVENTION

The present invention relates to a false twister, especially for producing spiral filaments, comprising a rotatably powered twister including at least one guide pulley around which the filaments are wrapped. The invention relates furthermore to a method of producing spiral filaments, more particularly in making use of a generic false twister in which at least two filaments are combined and plastically deformed in a false twister, including at least one guide pulley wrapped by the filaments.

The term filament in this case is not to be interpreted restrictive, but as also including both single and multiple filaments.

BACKGROUND OF THE INVENTION

A false twister and a generic production method are known from WO 97/12091 and WO 97/12092 originated by the same Applicant. The basic configuration and function of a false twister are likewise evident from JP-A 02-269885. A false twister comprises a rotatably powered twister including at least one guide pulley. For producing spiral filaments, several filaments are combined by a suitable means, passed through the twister parallel to the axis of rotation and wrapped around the guide pulley of the twister. A downstream outfeeder serves to move the filaments through the twister, rotation of which results in plastic deformation of the filaments. This plastic deformation is already produced in the false twister. The outfeeder provided downstream of the false twister results in the already plastically deformed filaments being exposed to high forces, as a result of which the plastic deformation is detremented and undesirable stresses are introduced in the filaments.

SUMMARY OF THE INVENTION

The objective of the present invention is thus to substantially reduce the forces acting on the filaments after plastic deformation.

In accordance with the invention this objective is achieved in a false twister of the aforementioned kind in that at least one guide pulley may be powered. In the production method in accordance with the invention the force needed to move the filaments through the false twister is applied to the filaments at least in part in the false twister.

The filaments are wrapped around the guide pulley so that forces can be communicated to the filaments when the guide pulley is powered. Before entering the false twister, up until being wrapped around the guide pulley, the filaments are intertwined in thus each supporting the other. It is in this zone that in addition very high stresses are needed in the filaments to produce the desired plastic deformation. In the zone between the guide pulley and the discharge from the false twister the spirally deformed filaments are separate from each other. The forces acting on the individual filaments are small since the force needed to move the filaments is furnished by the guide pulley wrapped by the filaments. Depending on the particular application it is possible to totally eliminate an outfeeder in thus reducing the space requirement and the costs of investment.

Advantageous aspects and further embodiments of the invention read from the dependent sub-claims.

Advantageously, the guide pulley is powered by the rotation of the twister in thus enabling a separate drive for the guide pulley to be eliminated in minimizing the mass of the twister and the investment costs.

In accordance with an advantageous further embodiment, the rotary speed of the powered guide pulley and the rotary speed of the twister can be varied relative to each other to permit optimum adaptation to the marginal conditions in each case in specifically setting the spiral shape of the filaments to be produced.

In one advantageous aspect a gear unit is provided applied to the twister for powering the guide pulley, this gear unit permitting coupling the guide pulley to a separate drive element in enhancing system flexibility.

In accordance with another advantageous further embodiment, the gear unit mates with a gearwheel separate from the twister to make for a simple, rugged, cost-effective design for a long useful life.

Advantageously, the gearwheel is arranged upstream or downstream of the twister to permit optimally adapting the false twister in accordance with the invention to the various marginal conditions such as how the twister is mounted or the space available.

In a first advantageous aspect the gearwheel is arranged fixed, the rotation of the guide pulley and the rotation of the twister being automatically coupled on rotation of the twister. More particularly, the rotary speed ratio is always the same as dictated by the translation of the gear unit and gearwheel. Any change in the rotary speed of the twister is automatically communicated to the guide pulley in thus enabling complicated control and adjustment procedures to be eliminated. Fluctuations in the rotary speed of the twister are automatically compensated.

In accordance with another advantageous further embodiment, the gearwheel is secured to a perforated disk for combining the filaments in thus eliminating the need for a separate mount for the gearwheel to further reduce the costs of investment.

In a second advantageous aspect the gearwheel can be rotatively powered. When the drive for the gearwheel is halted the coupling between the rotary speed of the twister and the rotary speed of the guide pulley, as described above, is automatically instigated. In addition, the rotary speed of the guide pulley can be set independently of the rotary speed of the twister by powering the gearwheel. This permits varying the shape in forming the spiral filaments in substantially enhancing the flexibility of the false twister in accordance with the invention.

Advantageously, the gear unit comprises a shaft rotatably mounted in the twister. This shaft permits the elimination of large dimensioned gearwheels having correspondingly high moments of mass inertia.

In accordance with yet another further embodiment, the shaft is arranged substantially parallel to the axis of rotation of the twister to thus reduce the space requirement in the radial direction.

In another advantageous aspect the guide pulley is provided with radially protruding flanges for guiding the filaments, as a result of which, the filaments are prevented from slipping off of the guide pulley.

Advantageously, the guide pulley is configured conically in the portion between the flanges. This conical configuration of the guide pulley ensures that the incoming filaments are always urged to the same flange in thus reliably preventing tangling of the filaments in the region of the guide pulley.

The method in accordance with the invention provides for the force needed to move the filaments through the false twister being provided at least in part in the false twister to the filaments to substantially reduce the force acting on the already plastically deformed filaments.

Advantageously, the force needed to move the filaments is provided in the false twister (10) to the filaments in the range of 10 to 100 percent, more particularly to more than 50 percent, more than 70 percent, more than 85 percent or more than 97 percent, the precise percentage of the force provided in the false twister to the filaments depending on the individual application, more particularly on the type of filaments involved, the diameter of the filaments, the material used as well as the spiral shape desired. The method in accordance with the invention permits optimum adaptation to the various conditions in each case.

In one advantageous aspect the wrap angle of the filaments around the guide pulley, especially the wrap number, is set as a function of the force provided in the false twister. The force communicated as a maximum by the guide pulley to the filaments is an exponential function of the wrap angle. Suitable adapting the wrap angle, especially via the wrap number, prevents any unwanted slip of the filaments relative to the guide pulley.

In accordance with one advantageous further embodiment, the rotary speed of the guide pulley and the rotary speed of the twister are varied relative to each other in changing the spiral shape of the filaments, the time needed to produce a winding being computed from the rotary speed of the twister. The rotary speed of the guide pulley together with its diameter gives the rotary speed with which the filaments are moved through the twister, and thus from the time needed to produce a winding the pitch of the spirals can be computed from the rotary speed and diameter of the guide pulley. By suitably varying the rotary speed of the guide pulley and/or the rotary speed of the twister, filaments differing in pitch can thus be produced.

In accordance with one advantageous aspect the spiral filaments are directly reeled on leaving the false twister to thus eliminate the need for a downstream outfeeder in furthermore saving space and costs of investment.

BRIEF DESCRIPTION OF THE DRAWINGS

The invention will now be detailed by way of example embodiments as shown in the drawing diagrammatically in which.

DETAILED DESCRIPTION OF THE PREFERRED EMBODIMENTS.

Figure 1:
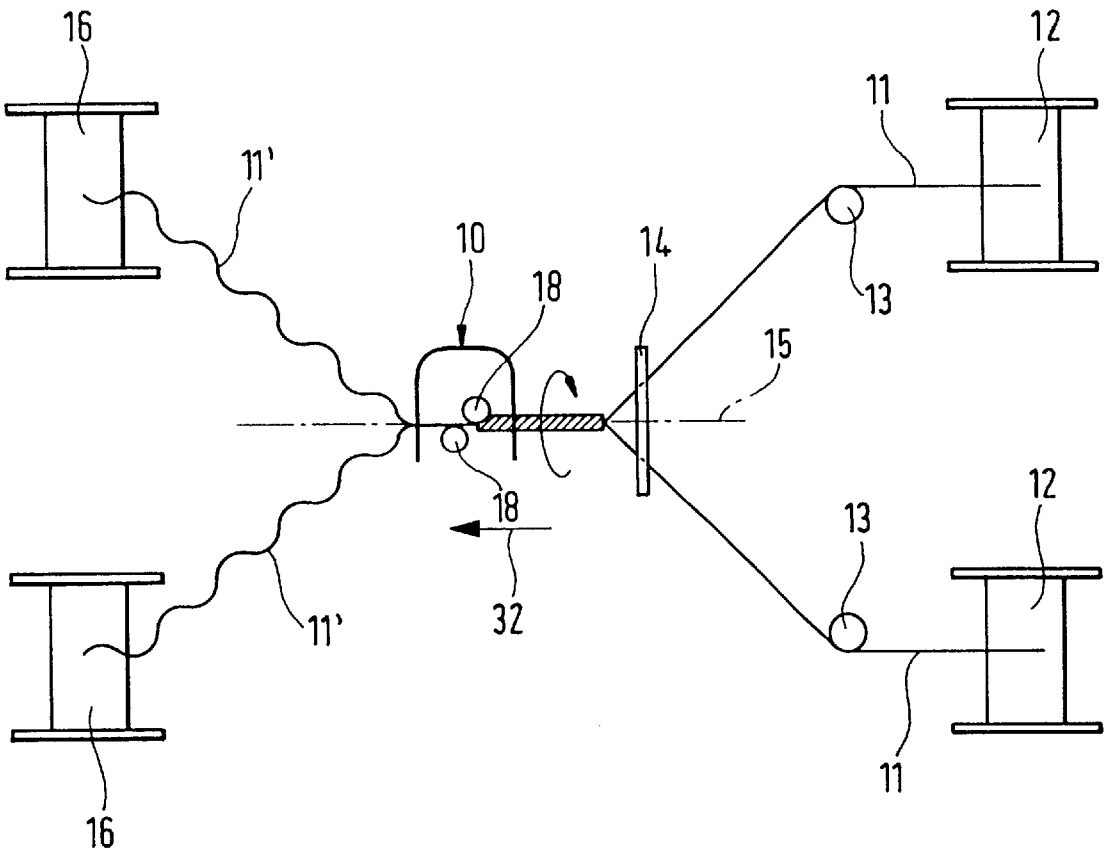
FIG. 1 is a diagrammatic view of the production procedure using a false twister in accordance with the invention.

Referring now to FIG. 1 there is illustrated the sequence in producing spiral filaments 11'. The filaments 11 are unreeled from reels 12 and guided via feed pulleys 13 through a perforated disk 14 in the direction of the arrow 32 through a false twister 10 and wrapped around the guide pulley 18 of the false twister 10. As shown in FIG. 1 diagrammatically, the false twister 10 is rotatively powered so that the individual filaments 11 are intertwined and plastically deformed. On leaving the false twister 10 the filaments 11' are separate from each other and spiral. The spiral filaments 11' are reeled on reels 16.

The false twister in accordance with the invention permits production of single as well as multiple spiral filaments and strands, whereby, of course, not only two but also three or more filaments, where necessary, may be simultaneously guided through and plastically deformed by the false twister 10.

Figure 2:
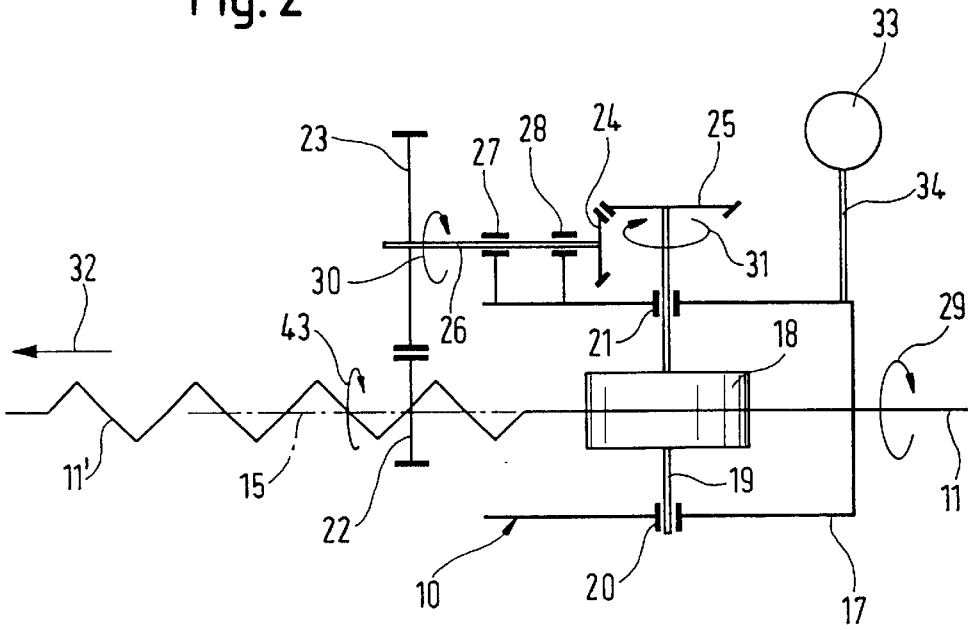
FIG. 2 is a diagrammatic view of how the false twister is powered with the powered guide pulley.

Referring now to FIG. 2 there is illustrated in a diagrammatic view the false twister 10 including a powered guide pulley 18. The false twister 10 comprises a twister 17 rotatively powered in the direction of the arrow 29 about an axis of rotation 15 by a motor 33 and a drive means 34. The filaments 11 are infed into the twister 17 parallel to the axis of rotation 15 and wrapped around the guide pulley 18.

The guide pulley 18 is applied to a shaft 19 rotatably mounted on the twister 17 by bearings 20, 21. For powering the guide pulley 18 a gear unit 23, 24, 25, 26 is mounted on the twister 17. The gear unit comprises a gearwheel 23 which is non-rotatably connected to a further gearwheel 24 via a shaft 26. This gearwheel 24 mates with a gearwheel 25 on the shaft 19 for the guide pulley. The shaft 26 is rotatably mounted on the twister 17 substantially parallel to the axis of rotation 15 thereof via bearings 27, 28.

The gear unit 23, 24, 25, 26 mates with a further gearwheel 22 which is separate from the twister. In the embodiment as shown in FIG. 2 the gearwheel 22 is arranged downstream of the twister 17. In this arrangement the gearwheel 22 may be fixed or rotatively powered in the direction of the arrow 43.

Rotation of the twister 17 causes the gearwheel 23 to advance along the gearwheel 22, the shaft 26 rotating in the direction of the arrow 30 with the gearwheel 22 fixed. This rotary movement is translated by the gear-wheels 24, 25 into a rotary movement of the guide pulley 18 in the direction of the arrow 31 in thus enabling the guide pulley 18 to be powered by rotation of the twister 17. In this arrangement the angular velocity of the guide pulley 18 is a function of the translation ratio between the gearwheels 22 and 23 as well as 24 and 25. The total translation ratio i is given by:

$$i=i_1\times i_2=z_1/z_2\times z_3/z_4$$

Where $z_1$, $z_2$ , $z_3$ and $z_4$ are the number of teeth of the gearwheels 22, 23, 24 and 25 respectively. This translation ratio i is independent of the actual rotary speed of the twister 17 in thus enabling the guide pulley 18 to be powered by rotation of the twister 17, the rotary speed of the guide pulley 18 being computed via the translation ratio i from the rotary speed of the twister 17.

The gearwheel 22 can be rotatively powered, as indicated diagrammatically by the direction of the arrow 43, in thus permitting the rotary speed of the powered guide pulley 18 and the rotary speed of the twister 17 to be varied relative to each other. When the gearwheel 22 is powered in the same direction of rotation as the twister 17, the rotary speed of the guide pulley 18 is reduced, whereas when powered in the opposite direction the rotary speed of the guide pulley 18 is increased. This permits setting various spiral shapes of the filaments 11'. From the rotary speed of the twister 17 the time needed to produce a winding can be computed. The rotary speed of the guide pulley 18 together with its diameter dictates the speed at which the filaments 11 are moved through the twister 17 in the direction of the arrow 32, i.e. by varying the rotary speed of the guide pulley 18 the pitch or twist length of the spiral filaments 11' can be set.

The powered guide pulley 18 results in the force needed to move the filaments 11 through the false twister 10 being applied directly in the false twister 10. The percentage of the force generated by the guide pulley 18 depends on the individual case. By setting the rotary speed of the guide pulley 18 the speed at which the filaments 11 are moved through the false twister 10 is established. This movement speed may be selected somewhat less then the reeling speed of the reels 16 as shown in FIG. 1. In this case the plastically deformed filaments 11' downstream of the false twister 10 are exposed to less stress. As an alternative, the rotary speed of the guide pulley 18 can be precisely adapted to the reeling speed of the reels 16. In this case the load on the plastically deformed filaments 11' is reduced to practically zero. To set the reeling speed of the reels 16 in adapting it to the rotary speed of the guide pulley 18 and twister 17 a suitable means of open or closed loop control (not shown) may be provided.

Figure 3:
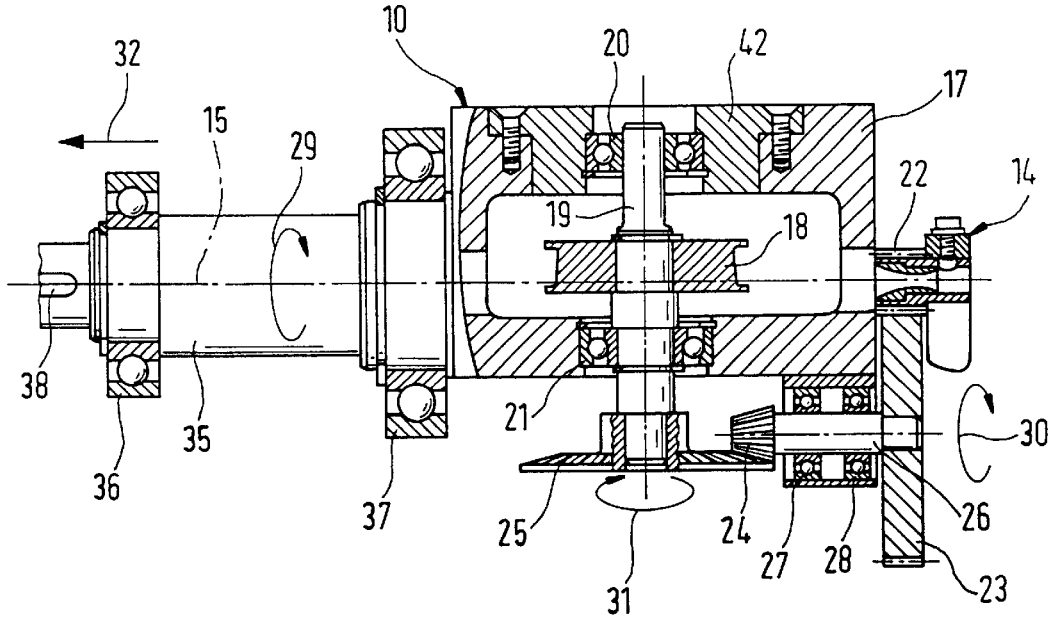
FIG. 3 is a longitudinal section through the false twister in accordance with the invention.
Figure 4:
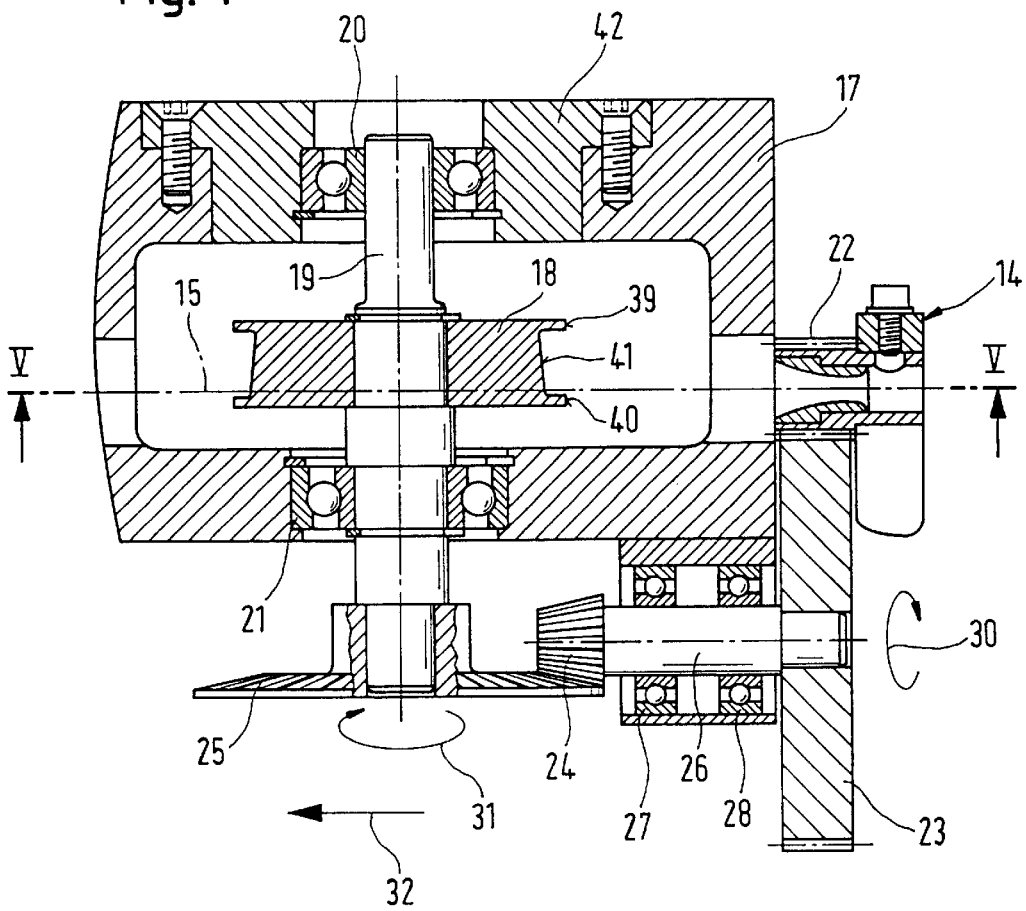
FIG. 4 is a magnified detail taken from FIG. 3.
Figure 5:
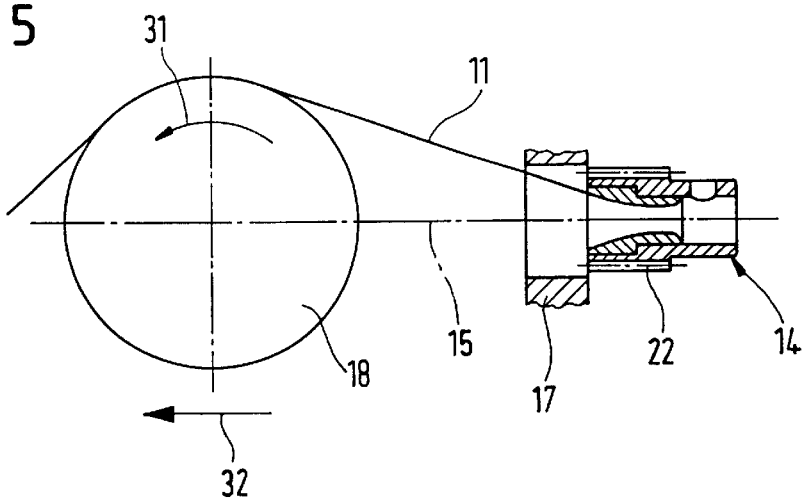
FIG. 5 is a diagrammatic view taken along the line V—V as shown in FIG. 4.

Referring now to FIGS. 3 to 5 there is illustrated a design embodiment of a false twister 10 in accordance with the invention. Like, and functionally identical, components as those in FIG. 2 are identified by like reference numerals, for the explanation of which reference is made to the comments as made above.

The false twister 10 comprises a shaft 35 which is mounted by means of bearings 36, 37 for rotation about the axis of rotation 15. The guide pulley is provided with a groove 38 which is engaged by the drive means 34. The filaments 11 are infed into the twister 17 in the direction of the arrow 32 where they are wrapped around the guide pulley 18 and subsequently communicated to the reels 16 through an inner bore of the shaft 35.

The guide pulley 18 comprises two flanges 39, 40 spaced away from each other for guiding the filaments 11. In the portion 41 between the flanges 39, 40 the guide pulley 18 is configured conically, as a result of which the filaments are always urged in the direction of the flanges to reliably prevent the filaments 11 becoming tangled in the region of the guide pulley 18. For assembling the guide pulley 18, shaft 19 and bearings 20, 21 the twister 17 is provided with a removable cover 42. The diameter of the cover 42 is larger than the outer diameter of the flanges 39, 40 of the guide pulley 18.

In the example embodiment as shown, the gearwheel 22 is arranged fixed and secured to the perforated disk 14 downstream of the twister 17 for combining the filaments 11 to thus permit eliminating an additional support for the gearwheel 22.

The filaments 11 are infed in the direction of the arrow 32 into the twister 17 through the perforated disk 14. In the twister 17 they are wrapped once or several times around the guide pulley 18. The guide pulley 18 is powered in the direction of the arrow 31 so that the force needed to move the filaments 11 through the false twister 10 is applied to the filaments 11 at least in part. The wrap angle of the filaments 11 around the guide pulley 18, especially the wrap number is set as a function of the force produced in the false twister. When only one guide pulley 18 is used, the wrap number can be varied, whereas when several guide pulleys 18 are employed, of which one or more is rotationally powered, the wrap angle can be varied by the mutual arrangement and diameter of the guide pulley 18 to thus reliably prevent any undesirable slip of the filaments 11 on the guide pulley 18 in each case.

Depending on the marginal conditions the spiral filaments 11' on leaving the false twister 10 can be directly reeled on the reels 16 without necessitating an outfeeder. Eliminating a downstream out-feeder reduces the investment costs and the space requirement.

In all, the present invention achieves a substantially reduction in the forces acting on the spiral filaments 11' after plastic deformation. By suitably adapting the rotary speed of the powered guide pulley 18 to the rotary speed of the twister 17 further different spiral shapes of the filaments 11' can be produced in thus significantly enhancing the flexibility of the false twister 10 in accordance with the invention.

What is claimed is:

1. A false twister for producing spiral filaments comprising a twister rotatably powered about a first axis of rotation and at least one guide pulley mounted on said twister and rotatable powered about a second axis of rotation; said twister is capable of being infed with said filaments parallel to said first axis of rotation and said guide pulley is capable of being wrapped around by said filaments so that forces are communicated to said filaments when said guide pulley is driven around said second axis of rotation; wherein said at least one guide pulley is powered, so that the force needed to move said filaments through said false twister is provided in said false twister to said filaments at least in part.

2. A false twister for producing spiral filaments, comprising a rotatable powered twister including at least one guide pulley wrapped around by said filaments, so that force needed to move said filaments through said false twister is provided in said false twister to said filaments at least in part, wherein said guide pulley is powered by rotation of said twister.

3. The false twister as set forth in claim 1, wherein the rotary speed of said powered guide pulley and the rotary speed of said twister are variable relative to each other.

4. A false twister for producing spiral filaments, comprising a rotatable powered twister including at least one guide pulley wrapped around by said filaments, so that force needed to move said filaments through said false twister is provided in said false twister to said filaments at least in part, wherein a gear unit mounted on said twister is provided for powering said guide pulley.

5. The false twister as set forth in claim 4, wherein said gear unit mates with a gearwheel separate from said twister.

6. The false twister as set forth in claim 5, wherein said gearwheel is arranged upstream or downstream of said twister.

7. The false twister as set forth in claim 5, wherein said gearwheel is arranged fixed.

8. The false twister as set forth in claim 5, wherein said gearwheel is secured to a perforated disk for combining said filaments.

9. The false twister as set forth in claim 5, wherein said gearwheel may be rotationally powered.

10. The false twister as set forth in claim 4, wherein said gear unit comprises a shaft rotatably mounted on said twister.

11. The false twister as set forth in claim 10, wherein said shaft is arranged substantially parallel to the axis of rotation of said twister.

12. The false twister as set forth in claim 1, wherein said guide pulley is provided with radial protruding flanges for guiding said filaments.

13. The false twister as set forth in claim 12, wherein said guide pulley is configured conically in a portion between said flanges.

14. A method of producing spiral filaments, comprising combining and plastically deforming at least two filaments in a false twister including a twister rotatably powered about a first axis of rotation and at least one guide pulley mounted on said twister and rotatable powered about a second axis of rotation; said filaments being infed into said twister parallel to said first axis of rotation and wrapped around said guide pulley so that forces are communicated to said filaments when said guide pulley is driven around said second axis of rotation; said filaments being intertwined in thus each supporting the other up until being wrapped around said guide pulley and being separate from each other after leaving said guide pulley, wherein said at least one guide pulley is powered so that the force needed to move said filaments through said false twister is provided in said false twister to said filaments at least in part.

15. The method as set forth in claim 14, wherein said force needed to move said filaments is provided in said false twister to said filaments in the range of 10 to 100 percent.

16. The method as set forth in claim 14, wherein the wrap angle of said filaments around said guide pulley is set as a function of the force provided in said false twister.

17. The method as set forth claim 14, wherein the rotary speed of said guide pulley and the rotary speed of said twister are varied relative to each other in changing the spiral shape of said filaments.

18. The method as set forth in claim 14, wherein said spiral filaments are directly reeled on reels after leaving said false twister.

19. The method as set forth in claim 14, wherein said force needed to move said filaments is provided in said false twister to said filaments in the range of 50 to 100 percent.

20. The method as set forth in claim 14, wherein said force needed to move said filaments is provided in said false twister to said filaments in the range of 70 to 100 percent.

21. The method as set forth in claim 14, wherein said force needed to move said filaments is provided in said false twister to said filaments in A the range of 85 to 100 percent.

22. The method as set forth in claim 14, wherein said force needed to move said filaments is provided in said false twister to said filaments in the range of 97 to 100 percent.

* * * * *